US006393751B1

(12) United States Patent
Liebenberg

(10) Patent No.: US 6,393,751 B1
(45) Date of Patent: May 28, 2002

(54) MODULAR FIREARM AND METHOD FOR MAKING THE SAME

(75) Inventor: Paul Liebenberg, Agawam, MA (US)

(73) Assignee: Smith & Wesson Corporation, Springfield, MA (US)

( * ) Notice: Subject to any disclaimer, the term of this patent is extended or adjusted under 35 U.S.C. 154(b) by 0 days.

(21) Appl. No.: 09/494,319

(22) Filed: Jan. 28, 2000

(51) Int. Cl.[7] ..... F41A 21/00
(52) U.S. Cl. ..... 42/75.01; 42/25
(58) Field of Search ..... 42/25, 75.01, 2, 42/29

(56) References Cited

U.S. PATENT DOCUMENTS

| | | | | | |
|---|---|---|---|---|---|
| 520,468 | A | | 5/1894 | Wesson | |
| 3,650,174 | A | | 3/1972 | Nelsen | 89/28 |
| 3,696,542 | A | * | 10/1972 | Eckfeldt et al. | 42/16 |
| 4,155,187 | A | * | 5/1979 | Lichtman | 42/11 |
| 4,253,377 | A | * | 3/1981 | Arnett | 89/163 |
| 4,342,169 | A | * | 8/1982 | Lichtman | 42/11 |
| 4,457,092 | A | * | 7/1984 | Hupp et al. | 42/25 |
| 4,563,937 | A | * | 1/1986 | White | 89/185 |
| 4,615,132 | A | * | 10/1986 | Smith | 42/25 |
| 4,793,085 | A | | 12/1988 | Surawski et al. | 42/84 |
| 5,024,016 | A | * | 6/1991 | Smith | 42/25 |
| 5,272,828 | A | | 12/1993 | Petrick et al. | 42/84 |
| 5,625,972 | A | | 5/1997 | King et al. | 42/84 |
| 5,704,153 | A | | 1/1998 | Kaminski et al. | 42/70.11 |
| 5,755,056 | A | | 5/1998 | Danner et al. | 42/84 |

* cited by examiner

*Primary Examiner*—Michael J. Carone
*Assistant Examiner*—M Thomson
(74) *Attorney, Agent, or Firm*—McCormick, Paulding & Huber LLP

(57) ABSTRACT

A modular firearm according to the present invention includes a breach face module receiver adapted for receiving a fully assembled breach face module. The breach face module includes a breach face and an extractor arm precisely located relative to the breach face for engaging a cartridge rim and ejecting the cartridge from the firearm. The extractor arm is pivotally mounted in the breach face module and is rotationally biased by an extractor spring to effect cartridge engagement. The location of the extractor arm and the size of the breach face are variable so that the breach face module can be adapted for use with a range of calibers. The exterior dimensions of the breach face module remain constant so that a single breach face module receiver may be used to manufacture firearms of various calibers.

7 Claims, 8 Drawing Sheets

MODULAR FIREARM AND METHOD FOR MAKING THE SAME

BACKGROUND OF THE INVENTION

Technical Field

The present invention relates generally to firearms and, more particularly, to a modular pistol and method for making the same by manufacturing and installing a breach face module into a pistol slide to simplify the manufacturing of the pistol.

BACKGROUND OF THE INVENTION

There are ongoing efforts to improve the manufacturability of firearms. Although the basic manufacturing processes have not changed, including metal forging, turning and milling, new manufacturing methods and advancements in machinery in recent years have automated manufacturing processes that historically have been manually controlled. Many firearm components and assemblies are still manually assembled or fitted together to ensure safety and proper operation, and increase reliability.

A critical component in a semi-automatic pistol is the pistol slide assembly. At best, the slide assembly requires an extensive amount of machining time to produce, and the assembly often requires custom fitting with mating components in order to properly chamber and fire a round of ammunition, eject the spent cartridge, and load a new round. Any misalignment or improper fit of the slide and associated components can effect firearm operation and firing consistency.

The pistol slide is manufactured from a forged blank of metal using a series of metal milling, drilling, broaching and surfacing operations. The slide frame includes several features which are critical to the pistol's performance and reliability. One such feature is the firing pin bore which contains the firing pin and firing pin spring. The firing pin travels through the firing pin bore and strikes the rear side of the ammunition cartridge to fire the pistol. If the firing pin bore is misaligned with the center of the cartridge, a misfire can occur that fails to fire the ammunition properly.

Machining the firing pin bore has proven to be very costly and labor intensive. The firing pin bore is long and narrow, and difficult to machine accurately. Conventional drilling is an inaccurate method to produce the bore because the thin, long drill bits typically used have a tendency to "walk," resulting in a mis-aligned bore. Electrode Discharge Milling (EDM) produces a more accurate bore but the process is time consuming and requires expensive machinery and tooling.

Another critical feature on the slide is the extractor arm which is a hook shaped member that extends into the firing chamber to grasp the rim of a spent cartridge and eject it from the pistol as the slide moves rearwardly after the pistol is fired. An extremely critical dimension to ensure proper ejectment of a spent cartridge is the axial distance between the engaging surface of the extractor arm hook and the pistol's breach face, which forms the rear wall of a firing chamber and supports the cartridge in the firing position. When the pistol is fired, the extractor hook travels rearwardly with the slide and engages the cartridge rim to pull the cartridge from the rear of the barrel. If the axial distance is too small, the cartridge may be fed improperly to the chamber, resulting in a jammed condition known as "fail to feed." If the distance is too large, the cartridge may not be ejected completely from the firing chamber, causing another jammed condition known as "fail to extract." Either type of jam is unacceptable for the user and the firearm.

The machining steps required to properly locate the extractor arm are very time consuming and laborious due to the cumbersome and intricate nature of the slide frame. Typically, after the firing axis is established, the breach face and an extractor port are located and produced with a broaching operation. Various related features are then machined in the slide frame to mount the extractor arm with respect to the breach face. Because each feature of the slide is produced within an allowable machining tolerance, and the tolerances of some features in the slide effect the manufacturing accuracy of other slide features, it has proven difficult, and hence expensive, to properly locate the extractor arm accurately within the slide frame. Inaccuracies result in inconsistent firearm operation.

There have been attempts to introduce modular design concepts to firearms, or design high-wearing components so they are easily replaced or repaired. None of the efforts to date, however, have greatly simplified manufacturing and assembly procedures of the slide and extractor arm. One previous effort focused on retrofitting an existing pistol slide with a replaceable breach face module in the event the G/F wears excessively. In the course of normal use, a worn breach face can be replaced by a module that includes a new breach face. The problem with this component is that the original extractor arm of the pistol is left alone. Any manufacturing, assembly or operational problems with the original slide frame remain unresolved. Hence, the difficulties in correctly and efficiently machining the slide frame to locate the ejector arm still exist.

The firearm industry needs an improved method of manufacturing a pistol which improves manufacturing consistency and reliability of operation. The present invention is drawn toward such a method of manufacture and an article produced by the same.

DISCLOSURE OF THE INVENTION

It is an object of the present invention to provide a firearm with a pre-assembled breach face module which includes the breach face and the extractor arm.

It is another object of the present invention to provide a manufacture a breach face module for various firearm calibers which can be used with common components to produce firearms in a range of calibers.

It is yet another object of the present invention to manufacture a pistol slide body which can be used with pistols of various calibers. It is still another object of the present invention to manufacture a pistol slide according to a method which improves efficiency and reduces dimensional deviations that adversely effect pistol performance.

According to the present invention, a modular firearm is includes a pistol frame that slidably mounts a barrel and slide assembly on parallel frame rails, the slide assembly including a breach face module manufactured separately and mountable to the slide for locating a cartridge in a firing chamber and ejecting the cartridge from the pistol, the breach face module further comprising an extractor hook assembly and a lateral surface, both of which can be located to accommodate ammunition cartridges of various sizes.

One feature of the present invention is the slide frame which is dimensioned identically so that pistols in a range of different calibers can be manufactured cost effectively.

Another feature of the present invention is the pre-assembled breach face module which eliminates difficult manufacturing procedures when producing the pistol slide.

Still another feature of the present invention is the breach face module that is easily adapted for various caliber sizes by altering the dimensions of the breach face and the size and location of the extractor arm.

These and other objects, features and advantages of the present invention will become more apparent in the light of the following detailed description of best mode embodiments thereof as illustrated in the accompanying drawings.

BEST MODE FOR CARRYING OUT THE INVENTION

Figure 1:
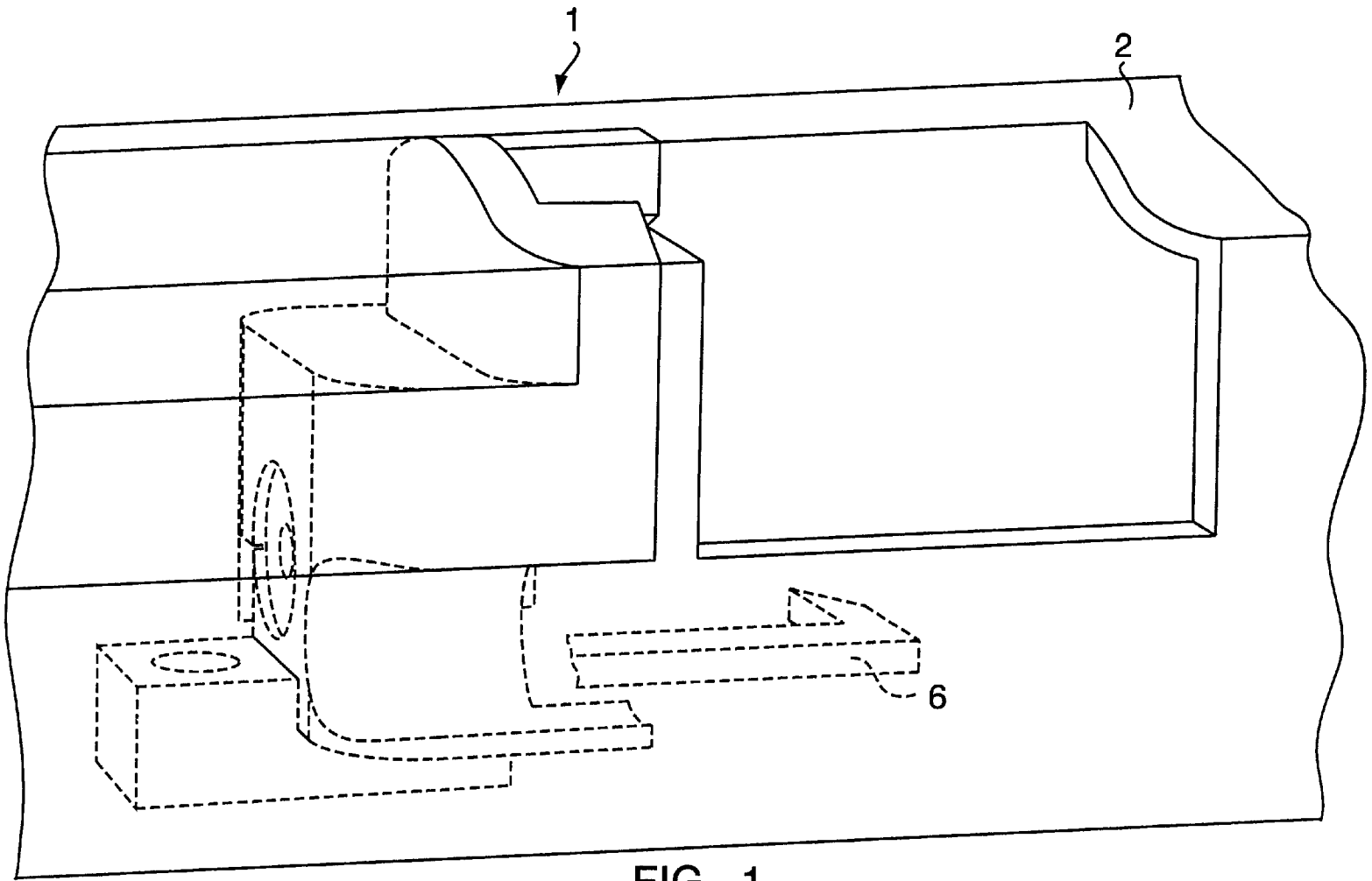
FIG. 1 PRIOR ART
FIG. 1 is a perspective view of a removable breach face component in the prior art secured within a cut-away pistol slide frame.

Referring to FIG. 1, a component 1 in the prior art is shown schematically as received in a slide frame 2 known design. The component 1 is designed by the Briley Manufacturing Company of Houston, Tex., and is configured to replace a worn breach face in a modified model M1911A1 pistol. Although the original M1911A1 pistol has a slide frame 2 with an integrated breach face, the slide frame 2 can be modified and retrofitted with component 1, thereby avoiding the expense of purchasing a new slide frame when the breach face wears. However, the slide frame 2 has an extractor arm 6 and related components which remain in their original positions when component 1 is installed, and the extractor arm 6 may or may not be functioning properly, or optimally located.

Additionally, overall manufacturability of the firearm is not improved, and critical features which locate and mount the extractor arm still need to be produced. Unlike the present invention, component 1 can not be used with a single configuration of slide frame 2 to assemble pistols of various cartridge caliber sizes.

Figure 2:
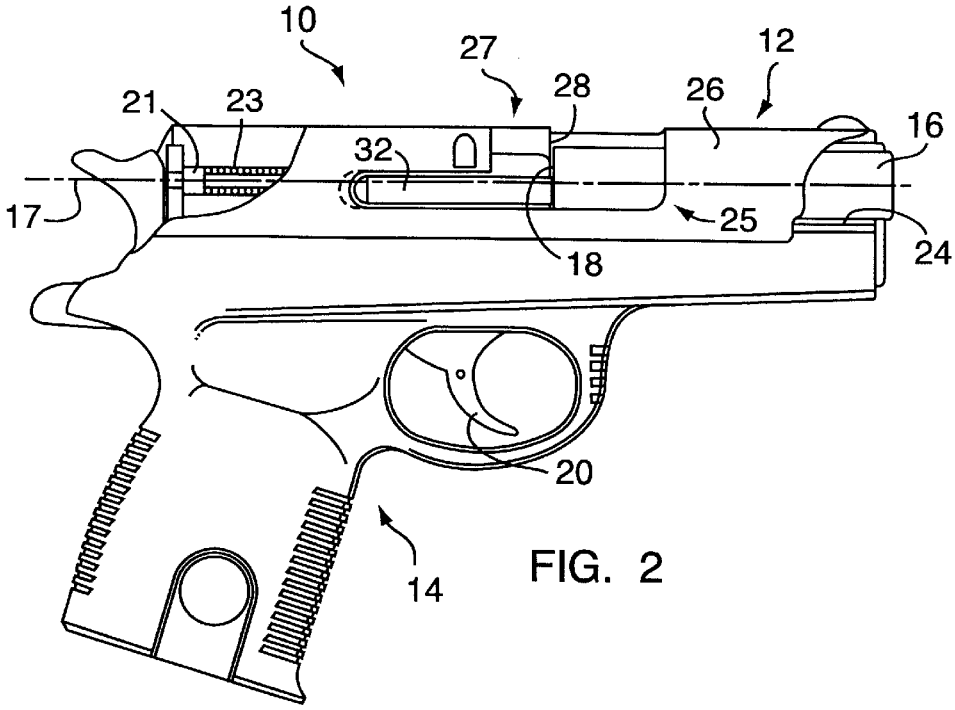
FIG. 2 is a schematic side view of a pistol manufactured according to the present invention shown with a breach face module and partially cut away slide assembly attached to a pistol frame.
Figure 3:
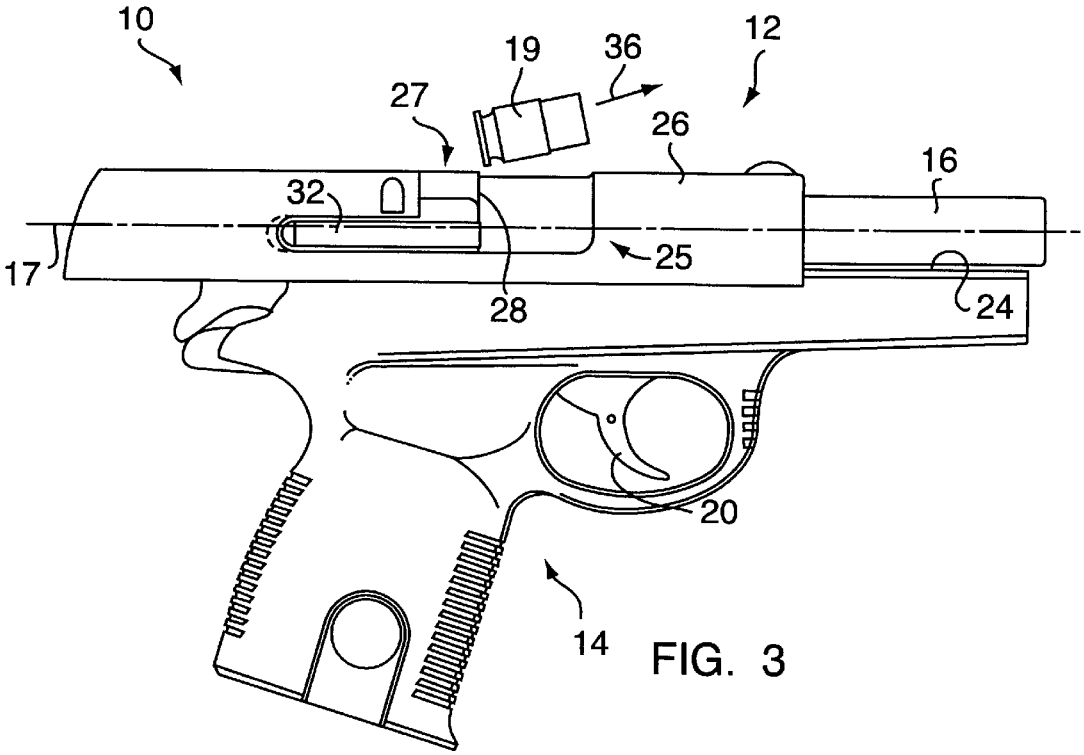
FIG. 3 is a schematic view of the pistol FIG. 2 shown with the slide assembly moved to a rearward position on the pistol frame.

Referring to FIGS. 2–3, a pistol 10 according to the present invention includes a slide assembly 12, a pistol frame assembly 14, and a barrel 16. The barrel 16 is disposed at a front aperture of the slide assembly 12, and, together with the slide assembly 12, the barrel 16 defines a longitudinal firing axis 17. The barrel 16 has a rear end 18 adapted for receiving an ammunition cartridge 19. A trigger 20 is pivotally mounted to the frame assembly 14 to actuate a firing mechanism (not shown) and fire the pistol 10. The firing mechanism acts on a firing pin 21 that is generally centered on firing axis 17, and enveloped and rearwardly biased by a firing spring 23.

The slide assembly 12 is fitted to rails 24 of the frame assembly 14 for reciprocal movement parallel to the firing axis 17. The slide assembly 12 defines an extractor port 25 and includes a slide frame 26 and a breach face module 27. The breach face module 27 is a pre-assembled unit which is non-movably mounted to the slide frame 26. The module has a breach face 28 which is engagable with the rear end 18 of barrel 16 to form a firing chamber when the slide assembly 12 is disposed forwardly on the frame assembly 14.

As discussed in detail later, an extractor arm 32 is mounted to the breach face module 27 to cooperate with the frame assembly 14 in ejecting the cartridge 19. In particular, when the slide assembly 12 is moved rearwardly, the firing chamber is exposed through the extractor port 25, and a shoulder (not shown) disposed in the frame assembly 14 acts with the extractor arm 32 to engage the cartridge 19 and eject it from the firing chamber through the extractor port 25 in a direction which is generally indicated, for example, by arrow 36.

The cooperation of the firing mechanism, the slide assembly 12 and the frame assembly 14 during the loading, firing, and ejecting of the cartridge 19 can be fully understood, for example, with reference to: U.S. Pat. No. 5,086,529 entitled Decocking mechanism for a semi-automatic pistol; U.S. Pat. No. 5,386,659 for a Fire Control Mechanism for a Semi-automatic pistol; U.S. Pat. No. 5,406,731 for a handgun of Improved Ergonomic Construction, all of which are commonly owned by the Applicant and are hereby incorporated by reference.

Figure 4:
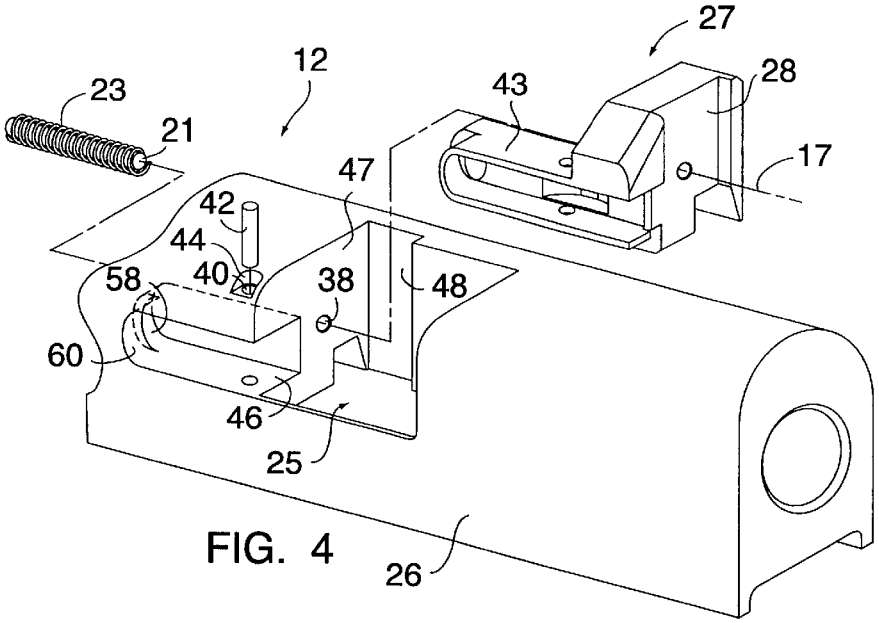
FIG. 4 is a schematic perspective view of a slide frame shown with the breach face module and firing pin disassembled.
Figure 5:
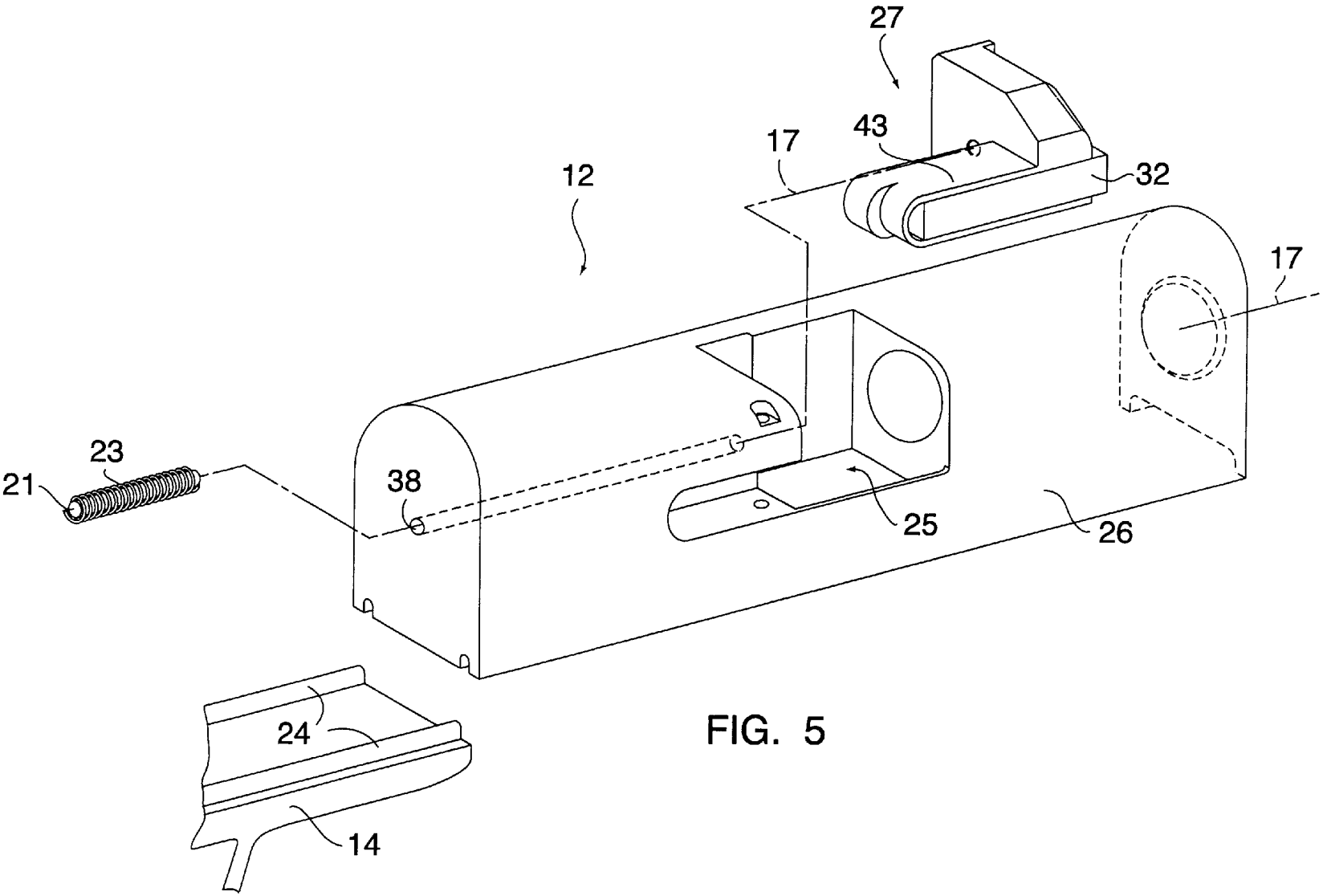
FIG. 5 is another schematic perspective view of the disassembled slide frame of FIG. 4.

Referring to FIGS. 4–5, the slide assembly 12 includes the slide frame 26 which mounts the breach face module 27 and firing pin 21 in alignment with the firing axis 17. The slide frame 26 has a firing pin bore 38 centered on the firing axis 17 with a constant diameter which is sized to allow smooth movement of the firing pin spring 23. The firing pin bore 38 extends longitudinally through the slide frame 26 from a rearward portion that exposes the firing pin 21 to the firing mechanism, to a bearing surface 39 that exposes the firing pin 21 to the breach face module 27.

A mount pin hole 40 is defined substantially vertically through the slide frame 26 and receives an extractor mount pin 42 which is press-fitted through the slide frame 26 and into an extractor arm housing 43 of the breach face module 27 to permanently secure the breach face module 27 in position. A mount pin recess 44 is provided in the slide frame 26 to facilitate machining of the mount pin hole 40 and also to provide a flush outer profile to the slide assembly 12 when the extractor mount pin 42 is installed.

Figure 6:
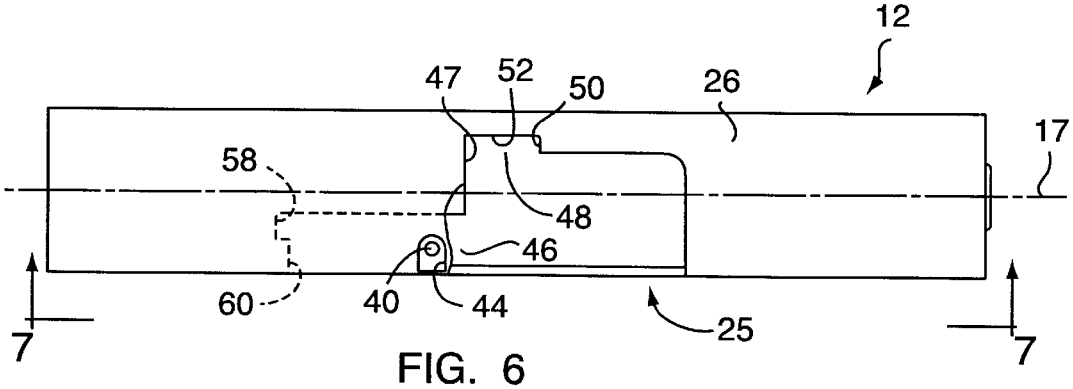
FIG. 6 is an elevated plan view of the slide frame of FIG. 4.

Referring to FIG. 6, the slide frame 26 includes a module pocket 46, a bearing surface 47, and a lateral pocket 48. The module pocket 46, which is discussed in detail below, is configured to snugly receive a portion of the breach face module 27. The lateral pocket 48 is also configured to receive a portion of the breach face module 27, and includes a forward face 50 and a side surface 52. The lateral pocket 48 is produced effectively using a single broaching operation to simultaneously generate the forward face 50 and the side surface 52.

Figure 7:
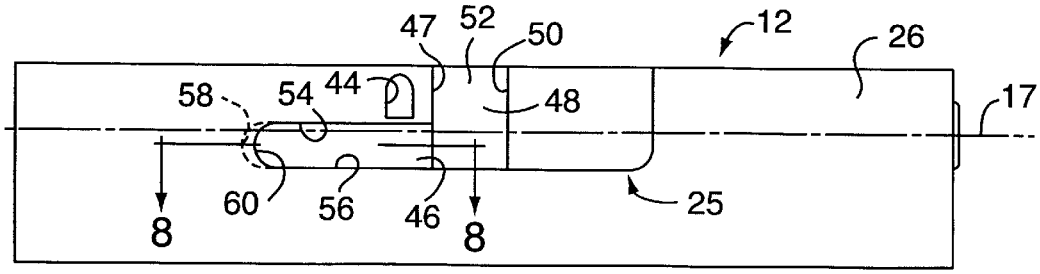
FIG. 7 is an elevated view of the slide frame of FIG. 6 taken along the line 7—7.
Figure 8:
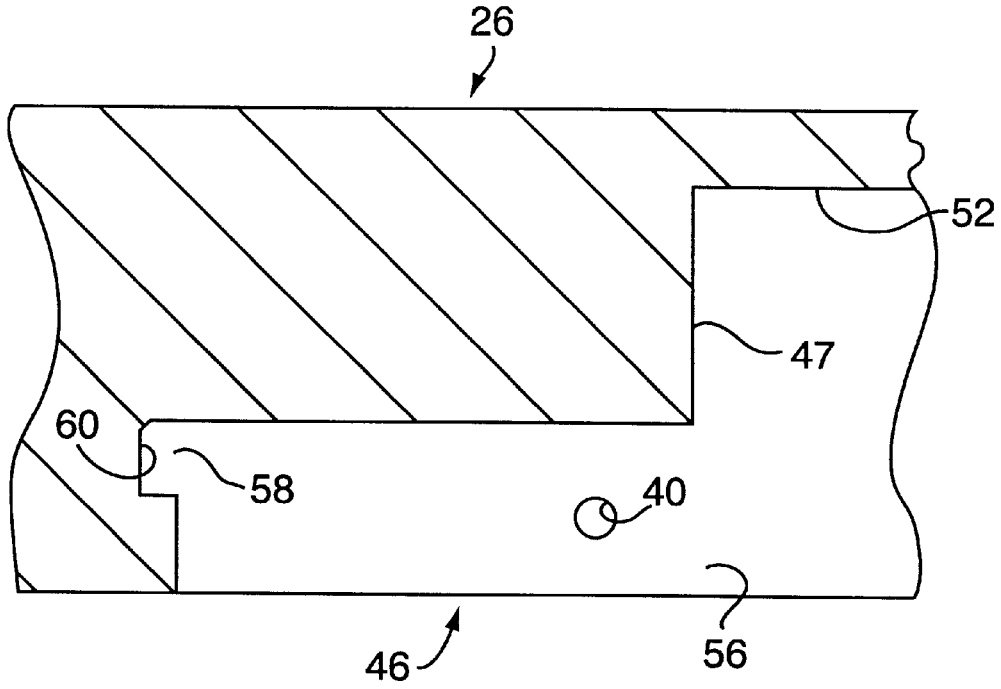
FIG. 8 is a sectional view of the slide frame of FIG. 7 taken along the line 8—8 and showing a module pocket and a rear recess.

Referring to FIGS. 7–8, the module pocket 46 includes upper and lower pocket surfaces 54, 56, a rear recess 58, and a contoured end 60 that receives the extractor arm housing 43 of the breach face module 27. The upper and lower pocket surfaces 54, 56 are parallel to one another and spaced apart to snugly receive the extractor arm housing 43. The rear recess 58 is configured to be concealed within the contoured end 60 and not visible when the breach face module 27 is installed in the slide frame 26. The rear recess 58 has a depth and cross sectional configuration that snugly receives the extractor arm housing 43.

Figure 9:
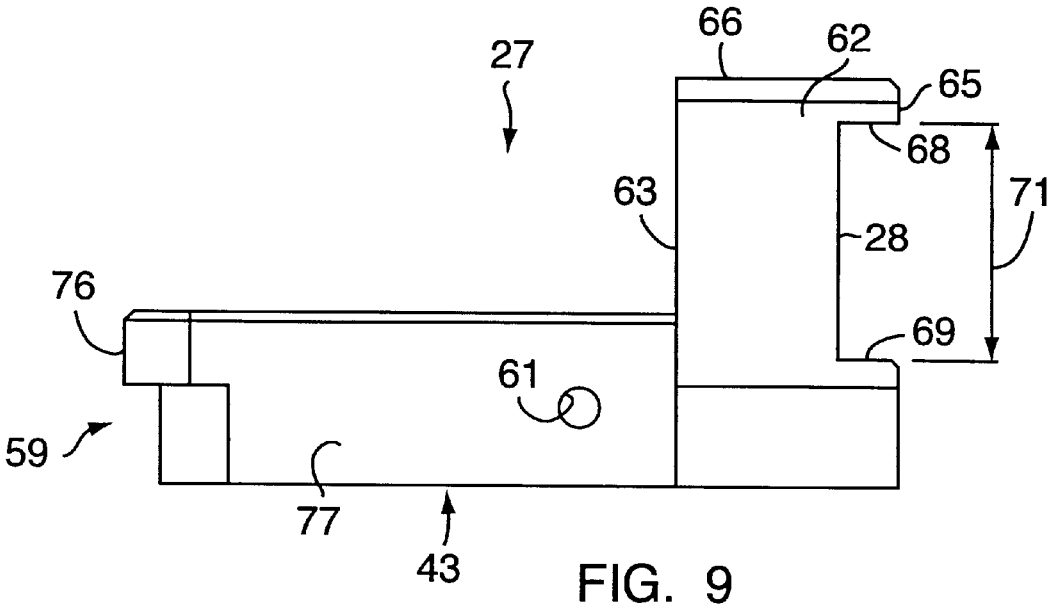
FIG. 9 is an enlarged plan view of the breach face module shown in FIG. 4.
Figure 10:
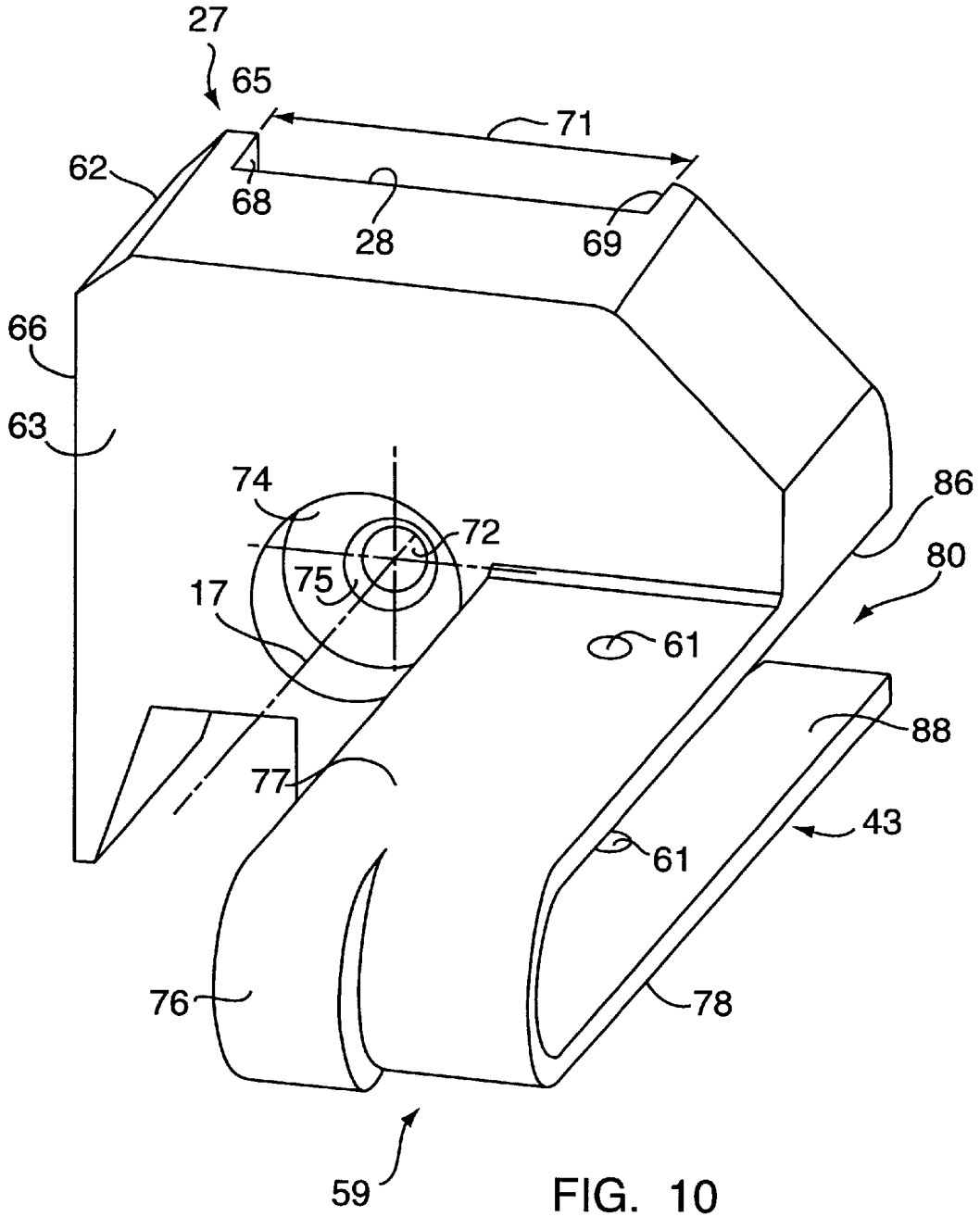
FIG. 10 is an enlarged perspective view of the breach face module similar to the view shown in FIG. 5.
Figure 11:
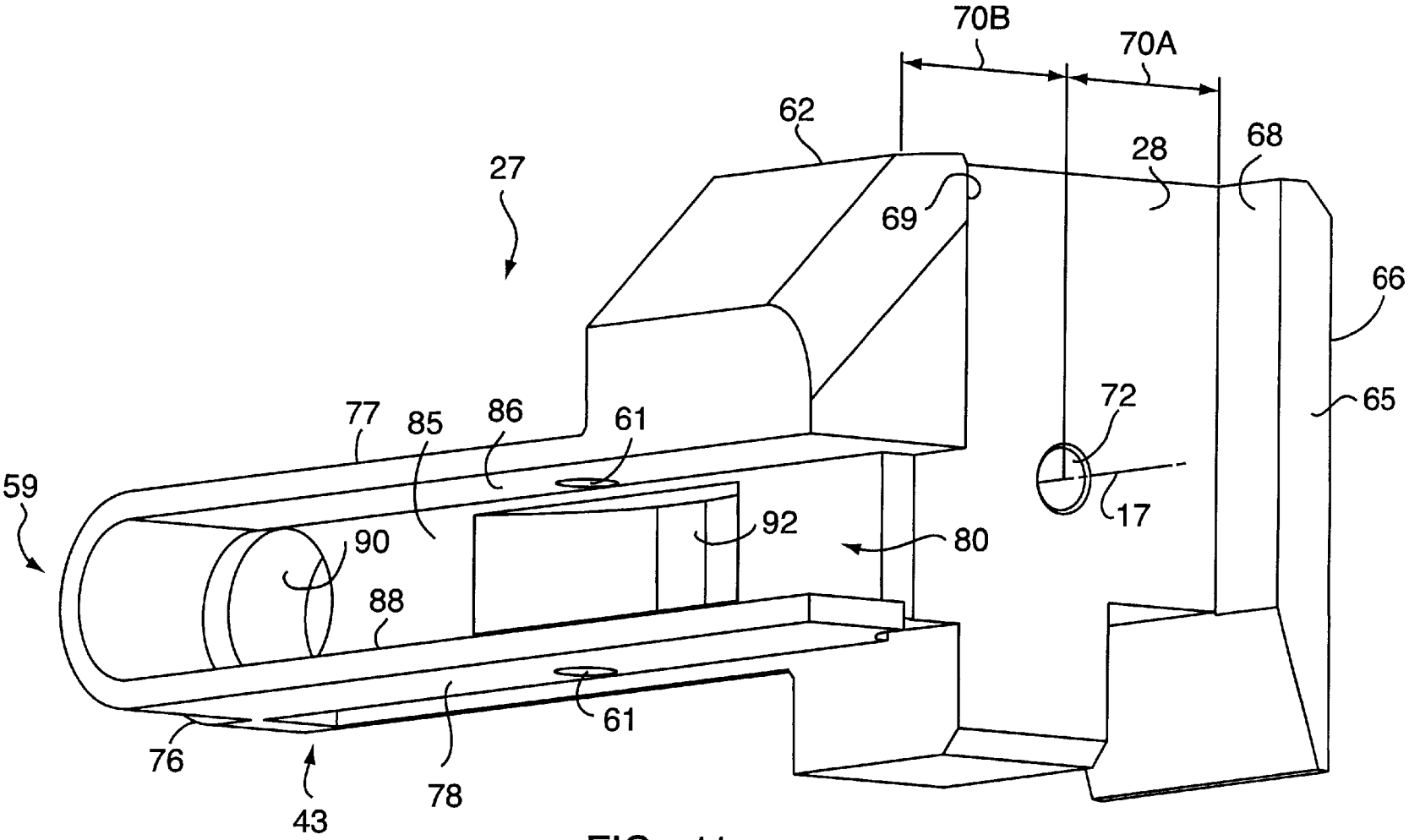
FIG. 11 is an enlarged perspective view of the breach face module similar to the view shown in FIG. 4.

Referring to FIGS. 9–11, the body of a breach face module 27 includes features adapted to anchor it to the slide frame 26, including a module mount hole 61, a lateral portion 62, a rear surface 63, and an extractor arm housing 64. The lateral portion 62 fits within the lateral pocket 48 of the slide frame 26 to prevent forward movement of the breach face module 27, and includes a forward shoulder 65 and a lateral face 66. When the breach face module 27 is installed in the slide frame 26, the forward shoulder 65 and lateral face 66 bear, respectively, against the forward face 50 and the side surface 52 of the slide frame 26. Likewise, the rear surface 63 bears against the bearing surface 47 of the slide frame 26.

The lateral portion 62 includes centering surfaces 68 and 69, that are spaced distances 70A, 70B from the firing axis 17 to center the cartridge 19 on the breach face 28, and in the firing chamber. According to one of the features of the invention, the distances 70A, 70B are changeable to accommodate different firearm calibers. For example, the table below provides various values for the distances 70A, 70B that will produce breach face modules for several popular cartridge sizes. It is to be understood that distances 70A, 70B are achieved by changing the location of the centering surfaces 68, 69 with respect to the firing axis 17. In other words, the firing axis of the module remains fixed with respect to the firearm, and only the relative locations of surfaces 68, 69 are changed. The overall width of the breach face is also given as dimension 71.

| | 45 Cal. ACP | 9 mm P | 40 S & W |
|---|---|---|---|
| Distance 70A, 70B (inches) | .245 | .217 | .213 |
| Breach face width 71 (inches) | .490 | .433 | .425 |

While the distance 71 is changed, it is important that the outer dimensions of the breach face module remain unchanged so that a single embodiment of the slide frame can be used with a range of breach face modules sized for different calibers. This is accomplished by altering the relative position of only the centering surfaces 68, 69. That is, the lateral face 66 remains in the same position relative to the firing axis 17, and the thickness of the lateral portion 62 is widened or narrowed to effectively change the location of the centering surfaces 68, 69.

A firing pin hole 72 and a counterbore 74 are defined on the firing axis 17, with the counterbore 74 extending into the breach face module 27 from the rear surface 63 to a depth which is sufficient to provide a forward bearing surface for the firing pin spring 23. For that reason, the counterbore 74 has a diameter which is generally the same as the diameter of the firing pin bore 38 of the slide frame 26, and the counterbore 74 aligns with the same when the breach face module 27 is installed in the slide frame 26. The firing pin hole 72 is centered in the counterbore 74 and extends longitudinally through the breach face module 27 to the breach face 28 so that the firing pin 21 can strike the cartridge 19 which is loaded in the firing chamber. The firing pin hole 72 includes a chamfer 75 of approximately 0.020 inches to facilitate travel of the firing pin 21 through the breach face module 27.

The extractor arm housing 43 is configured to fit within the module pocket 46 of the slide frame 26, and includes a tab 76, and parallel upper and lower outer surfaces 77, 78. The tab 76 extends from the distal end 59 in a direction generally parallel to the firing axis 17, and has a cross sectional area that conforms closely in shape and size to the cross section of the rear recess 58 of the module pocket 46. The closely matched cross sections of the tab 76 and rear recess 58 creates a tight fit when the breach face module 27 is installed in the slide frame 26. The embodiment of the tab 76 which is described and illustrated here has a rounded outer surface, but other cross sectional shapes are considered within the scope of the invention, such as a tab with a squared end. The shape of the tab 76 depends on the type and size of the firearm with which the breach face module is used.

The extractor arm housing 64 forms a three-sided inner compartment 80 which encloses the extractor arm 32 and related components discussed below. The inner compartment 80 includes a back wall 85 and parallel upper and lower inner surfaces 86, 88 which are spaced apart just enough to allow free movement of the extractor arm within the compartment. An extractor spring bore 90 extends perpendicularly into the back wall 85. An extractor pivot recess 92 is included to allow room for the extractor arm 32 to pivot within the extractor arm housing 64. The mount pin hole 61 is used as a reference in locating the extractor pivot recess 92.

Figure 12:
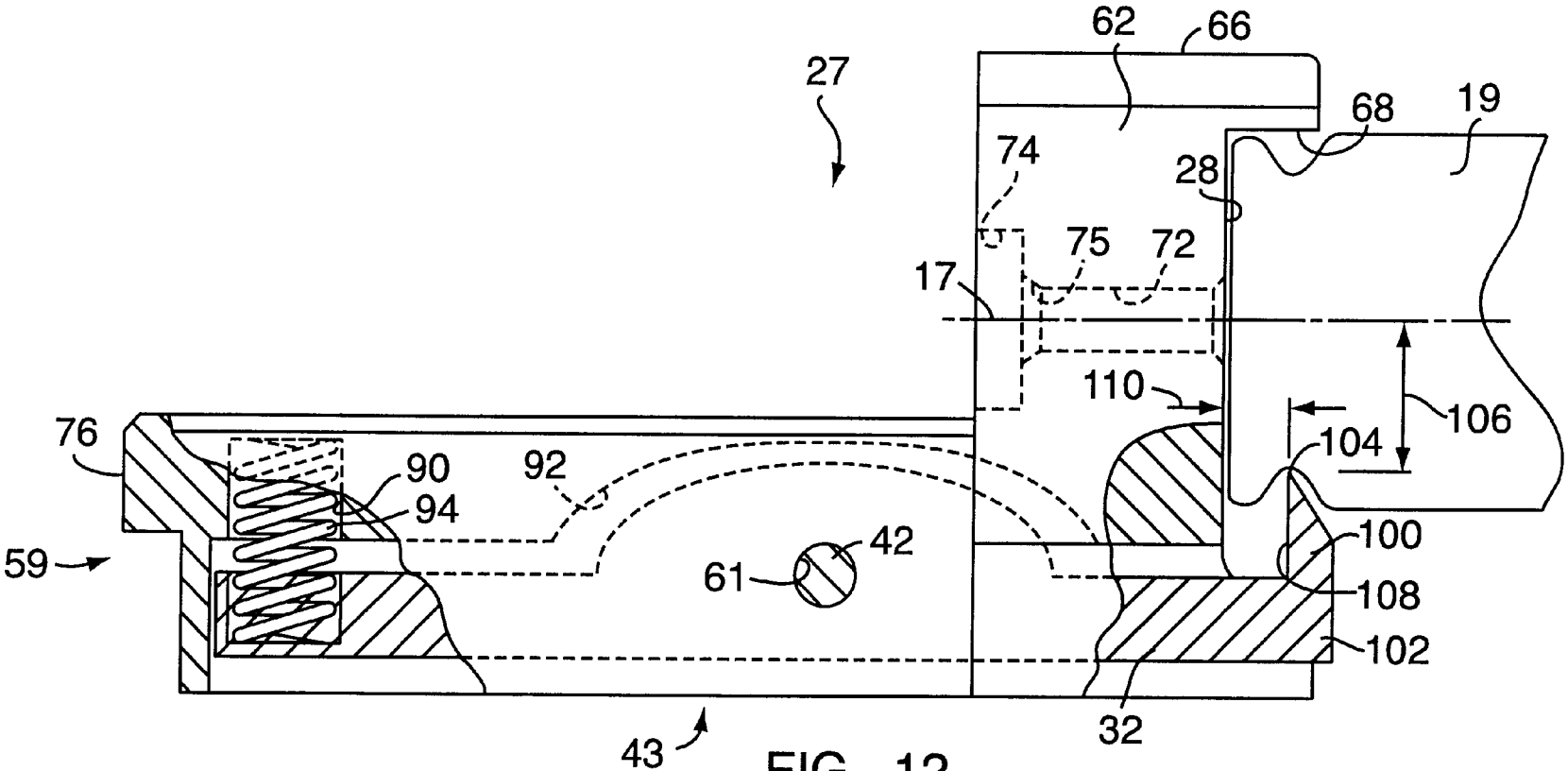
FIG. 12 is an enlarged elevational view of the breach face module of FIG. 4 sectioned to show an extractor spring and an extractor arm engaged on a cut-away cartridge.

Referring to FIG. 12, the assembled breach face module 27 includes an extractor spring 94, the extractor mount pin 42, and the extractor arm 32. The extractor spring 94 and extractor arm 32 are sized according to standards known in the art which consider the type and caliber of firearm which the components are used. The extractor spring bore 90 is appropriately sized to receive the extractor spring 94. The extractor mount pin 42 is press fitted vertically through the upper and lower surfaces 86, 88 and fits loosely through the extractor arm 32 to allow pivotal movement of the extractor arm 32 in a plane perpendicular to the breach face 28 and parallel to the firing axis 17.

The extractor arm 32 is designed according to standards known in the art, and includes an extractor hook 100 depending from a forward end 102 in a direction generally perpendicular to the firing axis 17. The extractor hook 100 has a hook tip 104 pointing toward the firing axis 17 and spaced a distance 106 therefrom. A hook face 108 is oriented substantially parallel to the breach face 28, and is spaced axially a distance 110 therefrom.

The distances 106, 110 are critical to consistent, reliable operation of the firearm, including proper and consistent loading and extraction of cartridges.

The modular firearm described above effectively reduces the number of components, and thus manufacturing steps, required to manufacture and assemble a firearm. A different slide frame is no longer required for each firearm caliber size because differently configured breach face modules are assembled into a common slide frame. The resulting slide frame assembly is then fitted with an appropriate firearm frame and barrel to complete assembly of the entire firearm having a desired caliber.

The embodiments of the present invention described in detail here are for use in a pistol. However, the invention is intended for, and is capable of being incorporated into, long guns and other types of firearms. The general principle disclosed herein utilizes a pre-assembled breach face module which is then installed into a common slide frame to reduce manufacturing time and improve manufacturability.

Installing the breach face module into the slide frame involves the use of a second pivot pin which is long enough to extend through the breach face module and into the upper and lower walls of the extractor housing 43. Once an assembled breach face module is positioned in the slide frame, the second pivot pin is inserted through the mount pin hole 40 of the slide frame and driven through the mount pin hole 61 of the breach face module. The breach face module is securely mounted when the end of the second pin is driven flush with the recess 44 on the slide frame. During the assembly process, the original pivot pin which assembled the breach face module is driven from the module and can be discarded. The module is removed by driving the second pivot pin from the slide assembly and releasing the breach face module from the slide frame.

While preferred embodiments have been shown and described above, various modifications and substitutions may be made without departing from the spirit and scope of the invention. For example, different methods of securing the breach face module to the slide are considered within the scope of the present invention, such as welding, riveting, or a press fit between components. Further, the lateral edge may be omitted in lieu of another suitable means of locating and centering the cartridge on the breach face. Still further, the present invention is described in detail in connection with a pistol; however, the intent of the description is not meant to limit application of the invention to pistols. Rifles and revolvers; for instance, can benefit from lessons taught herein. Accordingly, it is to be understood that the present invention has been described by way of example and not by way of limitation.

I claim:

1. A breach face module adapted to be received and secured in a firearm, in mechanical cooperation with and between a firing mechanism and a firearm barrel along a firing axis, said breach face module comprising:

a module body having a module axis coincident with the firing axis, said module body defined primarily between a forwardly facing breach face oriented perpendicularly to the module axis and a rearwardly facing bearing surface spaced apart and parallel to the breach face;

an extractor arm pivotally mounted to the module body and movable in a plane parallel to the module axis about a pivot axis offset from, and perpendicular to, said module axis;

an extractor spring biasing the second end in a direction that forces the first end generally toward the module axis;

a firing pin bore defined by and extending through the module body between the breach face and the bearing surface; and means for securing said breach face module to said firearm.

2. The breach face module of claim 1, wherein said firing pin bore comprises a countersunk portion on said bearing surface for receiving a firing pin spring.

3. The breach face module of claim 1, wherein said extractor arm has a hooked first end with a hook face substantially parallel to, and spaced axially along the firing axis a first distance from, the breach face, said hooked first end having a hook tip displaced a second distance from, and pointing toward, the module axis to engage a cartridge rim, said extractor arm having a second end disposed on an opposite side of the pivotal mount from the first end.

4. The breach face module of claim 1, wherein said firing pin bore is defined along said module axis.

5. The breach face module of claim 1, wherein said firing pin bore is offset from, and parallel to, said module axis.

6. The breach face module of claim 1, wherein said positioning means and said extractor arm are configured to position a cartridge on the firing axis, said cartridge being selected from the group consisting of .356, .357, .38, .40, and .45 calibers.

7. The breach face module of claim 1, wherein said means for securing said breach face module to said firearm further comprises a pin insertable between the breach face module and the firearm.

* * * * *